US005574241A

United States Patent [19]

Kumano et al.

[11] Patent Number: 5,574,241

[45] Date of Patent: Nov. 12, 1996

[54] KEYBOARD APPARATUS WITH COMMON STOPPER FOR KEY AND HAMMER

[75] Inventors: Shinji Kumano; Takamichi Masubuchi, both of Hamamatsu, Japan

[73] Assignee: Yamaha Corporation, Japan

[21] Appl. No.: 359,031

[22] Filed: Dec. 19, 1994

[30] Foreign Application Priority Data

Dec. 24, 1993 [JP] Japan ..... 5-325679

[51] Int. Cl.[6] ..... G10C 3/12

[52] U.S. Cl. ..... 84/439; 84/433; 84/436

[58] Field of Search ..... 84/433–436, 439, 84/440, 441, DIG. 7, 719, 644, 670

[56] References Cited

U.S. PATENT DOCUMENTS

| | | | |
|---|---|---|---|
| 4,901,614 | 2/1990 | Kumano et al. | 84/1.1 |
| 5,249,497 | 10/1993 | Niitsuma | 84/247 |
| 5,406,875 | 4/1995 | Tamai et al. | 84/433 |

FOREIGN PATENT DOCUMENTS 2-19468 5/1990 Japan .

*Primary Examiner*—Patrick J. Stanzione
*Attorney, Agent, or Firm*—Graham & James LLP

[57] ABSTRACT

A keyboard apparatus is constructed on a frame having a plurality of support members. A plurality of keys are movably supported by the corresponding support members such that each key can be operated by a finger action to undergo a primary stroke movement. A plurality of mass members are disposed in the frame. Each mass member is linked to a corresponding key for undergoing a secondary stroke movement in response to the primary stroke movement of the corresponding key so as to impart a dynamic reaction to the finger action. A stopper member is disposed in the frame not only for directly fixing a limit of the secondary stroke movement of each mass member, but also for indirectly fixing a limit of the primary stroke movement of the corresponding key. Further, a plurality of guiding members are arranged in the frame remotely from the support members and correspondingly to the respective keys. Each guiding member is shaped in point contact with the corresponding key so as to guide the primary stroke movement thereof.

18 Claims, 10 Drawing Sheets

KEYBOARD APPARATUS WITH COMMON STOPPER FOR KEY AND HAMMER

BACKGROUND OF THE INVENTION

The present invention relates to a keyboard apparatus, and particularly relates to the keyboard apparatus used in an electronic musical instrument constructed to impart a dynamic reaction to a finger action to thereby improve a key touch. More specifically, the invention relates to the keyboard apparatus provided with a mass member such as a hammer arranged to produce good key stop touch. Further, the invention relates to the keyboard apparatus constructed such that key members are well fitted into a support to provide good operability of the key members.

U.S. Pat. No 4,901,614 discloses a conventional keyboard apparatus having a hammer linked to a corresponding key. In the conventional keyboard apparatus, the key is pivotably supported at its rear end portion by a keyboard frame. A free front end portion of the key is depressed by a finger action so that a contact portion of the key abuts with a side face of the hammer to depress the hammer in linked manner to the key. The contact portion is disposed downward on a side of the key at a lengthwise intermediate portion closer to the rear end than the front end. The hammer has a rear end portion pivotably supported by the frame, a front free end portion and an intermediate contact portion which is depressed by the key. In such a construction, a distance from the rear end portion to the contact portion is set smaller than another distance from the free end portion to the contact portion so that the free end portion is accelerated in the pivotal movement of the hammer to increase a load resistance thereof to create a heavy key touch. Such an acceleration mechanism can efficiently create a relatively heavy key touch by a relatively small weight of the hammer. Therefore, the keyboard apparatus having such a hammer can reduce an overall weight and can improve a dynamic key touch upon depression, as compared to another keyboard apparatus having a static weight attached to the free end portion of the key instead of a dynamic hammer. The dynamic key touch is a dynamic reaction received by a finger dependently on a depressing strength of the finger. The dynamic reaction is increased as an inertial moment of the key and the hammer is made greater. The inertial moment I is represented by $I=m\cdot r^2$ where m denotes a mass disposed at one end of the hammer, and r denotes a distance from a pivot center to the mass. The longer the distance r, the greater the inertial moment I. Accordingly, the hammer is pivotably disposed within a given space of the keyboard apparatus while a fulcrum of the hammer is positioned far from a mass center of the hammer, i.e., a center of gravity, thereby creating a heavy and dynamic key touch likewise an acoustic piano instrument.

Such a type of the keyboard apparatus having the hammer is provided with a pair of separate stopper means. The one stopper means is placed in direct contact with the key to fix upper and lower limits of a stroke movement of the key, while the other stopper means is placed in direct contact with the free end of the hammer to limit a stroke movement of the hammer. Further, the conventional keyboard apparatus is provided with guide means which is engaged with the free end portion of the key to vertically guide the stroke movement of the key while preventing a torsional displacement and a lateral swing of the key. The guide means is comprised of a guiding member elected on the keyboard frame and inserted into tile key in slide contact with opposed inner faces of the key to linearly guide the same along the vertical direction.

However, due to the above mentioned angular acceleration mechanism, the hammer stroke is normally set three times as long as the key stroke. Consequently, a gap between upper and lower stoppers of the key is significantly different from another gap between upper and lower stoppers of the hammer. It is difficult to match positions of the key stoppers and the hammer stoppers with each other. For example, if an effective position of the key stopper is shifted by 1 mm, a corresponding effective position of the hammer stopper must be shifted by 3 mm. The key stopper is composed of a felt or else which deeply sinks when the finger strongly hits the key and which shallowly sinks when the finger weakly hits the key. The hammer stopper is also composed of a felt or else which must sink three times as much as the key stopper. The hammer stopper must have a sufficient and accurate thickness to absorb a variable sink amount dependent on the strength of key hits. Therefore, accurate work is required for production of the components and assembly of the keyboard, such as the key stoppers and the hammer stoppers must be positioned in matching with each other, resulting in bad production efficiency and cost-up. The key stoppers and the hammer stoppers may be positioned discrepantly relative to each other, hence the key stroke is made inaccurate to cause incompatible key touch.

There is another drawback as to the compatibility of the stopper members relative to other parts in addition to the above mentioned drawback of the positional discrepancy among the stopper members. For example, the keyboard frame may have a structural distortion which may cause an erroneous alignment of the stoppers even if the felt material thereof has a proper thickness. Consequently, a stop position of the key may be offset from that of the corresponding hammer, thereby causing an incompatibility of key touches at the start or stop of the finger action. Particularly, if a positional error exists at the lower stoppers which limit a downward stroke movements of the key and the hammer, the hammer may bounds to vibrate at the key depression. Such a vibration may generate a noise, or may be transmitted to the key to generate an incompatible key touch.

In order to remove such an ill vibration of the hammer due to inaccuracies of the keyboard assembling and the parts working, a spacer tape may be attached to a vibrating portion. Otherwise, a total thickness of the felt of the stopper may be excessively increased to absorb the vibration. However, such a treatment further complicates the assembling work, and otherwise hinders a firm key touch at the stoppage. As an alternate choice, a defective keyboard frame may be provisionally eliminated to avoid ill vibration of the hammer. However, such a treatment would raise a total production cost of the keyboards.

In addition, dislocation of the stoppers may emerge as the time passes. Normally the hammer stopper can be correctly positioned relative to the key stopper just after the assembling work. However, after repeated stroke movements up to several thousand or several ten thousand times in a long period of the practical use, the lower stopper of the hammer may suffer from a permanent compressive deformation beyond an elastic limit. Further, the upper stopper of the hammer continuously receives an upward bias from the hammer so that each stopper is variably deformed by an aging effect dependently on a stroke frequency of each key. Consequently, the hammer stopper becomes dislocated from the corresponding key stopper to thereby generate the incompatible key touch and the ill vibration of the hammer due to bounds at the stopper.

Aside from above, as disclosed in the U.S. Pat. No. 4,901,614, the conventional keyboard apparatus is provided with the guide member which is inserted into the free front end portion of the key, and which has an extremely elongated shape in the vertical direction. Such a guiding structure may increase an overall thickness and a total weight of the keyboard, and may complicate an internal construction of the keyboard. Particularly, a front part of the keyboard is made thick so that a space between the keyboard and a player's knee is tight, thereby hindering operability of the keyboard when the player sits in front of the keyboard. Further, in the conventional keyboard apparatus, the key is supported at its rear end pivotably only in the vertical direction to allow the stroke movement. In such a support structure, the guided free end portion is occasionally not aligned with the supported rear end portion when the key is assembled into the frame. Such a misalignment may cause an ill play of the supported portion to generate a noise, or otherwise may impose a subsidiary stress to the supported portion to shorten the life of the key.

SUMMARY OF THE INVENTION

In view of the above noted drawbacks of the prior art, a first object of the invention is to provide a keyboard apparatus constructed to efficiently facilitate assembling work while eliminating alignment work of key and hammer stoppers, to achieve the accuracy of the key stroke movement to improve key touches at the start or stop of the key depression, and to maintain the accurate key stroke under repeated operation of the key depression to ensure comfortable key touches. A second object of the invention is to provide a keyboard apparatus featuring a reduced overall thickness and an improved operability. A third object of the invention is to provide a keyboard apparatus having a support construction for supporting keys without mechanical stress, unnecessary play, uncomfortable noise and subsidiary distorsional displacement or rolling, thereby improving fitness of keys in assembling and operability of keys.

According to the first aspect of the invention, a keyboard apparatus comprises a plurality of keys arranged such that each key is operable by a finger action to undergo a primary stroke movement, a plurality of mass members arranged such that each mass member is linked to a corresponding key for undergoing a secondary stroke movement in response to the primary stroke movement of the corresponding key so as to impart a dynamic reaction to the finger action, and stopper means disposed not only for directly fixing a limit of the secondary stroke movement of each mass member, but also for indirectly fixing a limit of the primary stroke movement of the corresponding key. In a specific form, the stopper means comprises a stopper member positioned to abut with a corresponding mass member such as a hammer when the same reaches the fixed limit of the secondary stroke movement so that a corresponding key is consequently locked when the same reaches the fixed limit of the primary stroke movement.

According to the second aspect of the invention, a keyboard apparatus comprises a plurality of support members, a plurality of keys movably supported by the corresponding support members such that each key can be operated by a finger action to undergo a primary stroke movement, a plurality of mass members arranged such that each mass member is linked to a corresponding key for undergoing a secondary stroke movement in response to the primary stroke movement of the corresponding key so as to impart a dynamic reaction to the finger action, stopper means disposed not only for directly fixing a limit of the secondary stroke movement of each mass member, but also for indirectly fixing a limit of the primary stroke movement of the corresponding key, and guide means comprised of a plurality of guiding members arranged remotely at a certain distance from the support members and correspondingly to the respective keys, each guiding member being shaped substantially in point contact with the corresponding key so as to guide the primary stroke movement thereof. In a more general form, a keyboard apparatus comprises a plurality of keys movably supported such that each key can be operated by a finger action to undergo a primary stroke movement, a plurality of mass members arranged such that each mas member is linked to a corresponding key for undergoing a secondary stroke movement in response to the primary stroke movement of the corresponding key so as to impart a dynamic, reaction to the finger action, stopper means arranged not only for directly fixing a limit of the secondary stroke movement of each mass member, but also for indirectly fixing a limit of the primary stroke movement of the corresponding key, and guide means comprised of a plurality of guiding members arranged correspondingly to the respective keys, each guiding member being shaped in substantial point contact with either of the corresponding key and the linked mass member so as to guide the concurrent primary and secondary stroke movements while suppressing a subsidiary displacement other than the primary and secondary stroke movements. By such a construction, an overall thickness of the keyboard apparatus can be reduced to thereby provide a sufficient room under an array of the keys to facilitate a keyboard play in a sitting posture. Further, a single guiding member is provided in point contact with one of the key and the mass member linked with each other to stably guide both of the concurrent primary and secondary stroke movements.

According to the third object of the invention, a keyboard apparatus comprises a plurality of keys each having a front end portion and a rear end portion, and being operable by a finger action applied to the front end portion so as to undergo a stroke movement pivotably around the rear end portion in a vertical direction, support means for movably supporting the rear end portion of each key, the support means comprising a corresponding pair of a convex part and a concave part which receives therein the convex part, one of the convex part and the concave part being formed at the rear end portion of each key while the other of the convex part and the concave part standing upright, the convex part having a pair of outer side faces which are laterally opposite to each other and the concave part having a pair of inner side faces which are also laterally apposite to each other, the convex part being fired into the concave part such that one outer side face and one inner side face are shaped in line contact with each other while another outer side face and another inner side face are shaped in spot contact with each other, thereby the support means allowing not only the pivotal stroke movement of each key in the vertical direction, but also allowing an adjustive pivotal displacement of the same key in a lateral direction, while prohibiting a subsidiary torsional displacement of the same key, and coupling means for firmly coupling the convex part and the concave part with each other to prevent each key form dropping off the support means. In a preferred form, a guiding member is provided in combination with a corresponding support member such that the guiding member is shaped substantially in point contact with either of a corresponding key and a mass member so as to guide the concurrent primary and secondary stroke movements while suppressing a subsidiary displacement. By such a construction, the spot contact between the convex and concave part allows the pivotal primary stroke movement of the key in the vertical direction, and the line contact between the convex and concave parts allows the adjustive pivotal displacement of the same key in the lateral direction. Further, the combination of the spot and line contacts efficiently suppresses the subsidiary torsional displacement or rolling of the key even if a guiding member is eliminated. Alternately, a guiding member of the point contact type can be adopted since the subsidiary torsional displacement is suppressed by the corresponding support member.

DETAILED DESCRIPTION OF EMBODIMENTS

Figure 1:
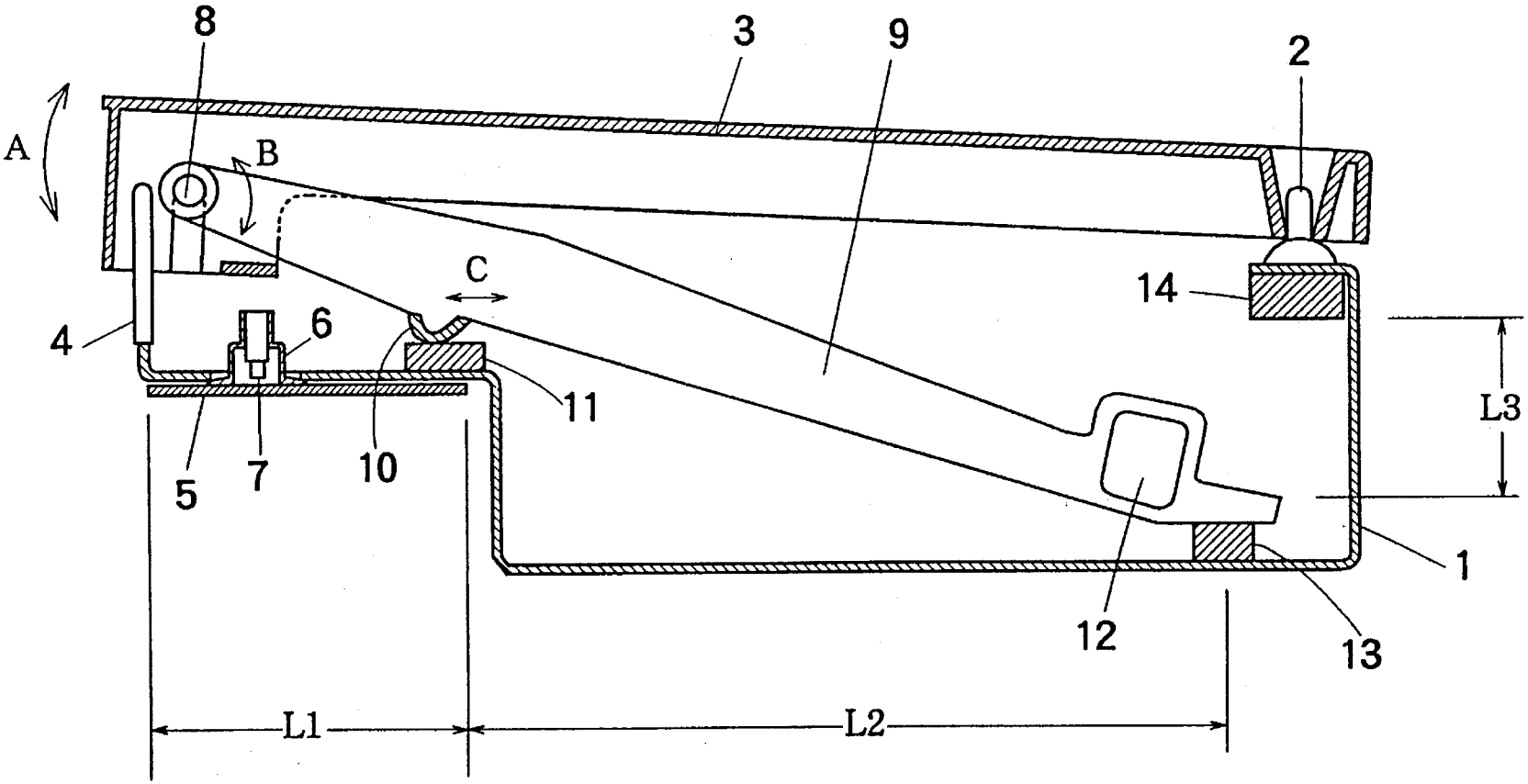
FIG. 1 is a sectional diagram showing one embodiment of the inventive keyboard apparatus where a key is held in a rest state.
Figure 2:
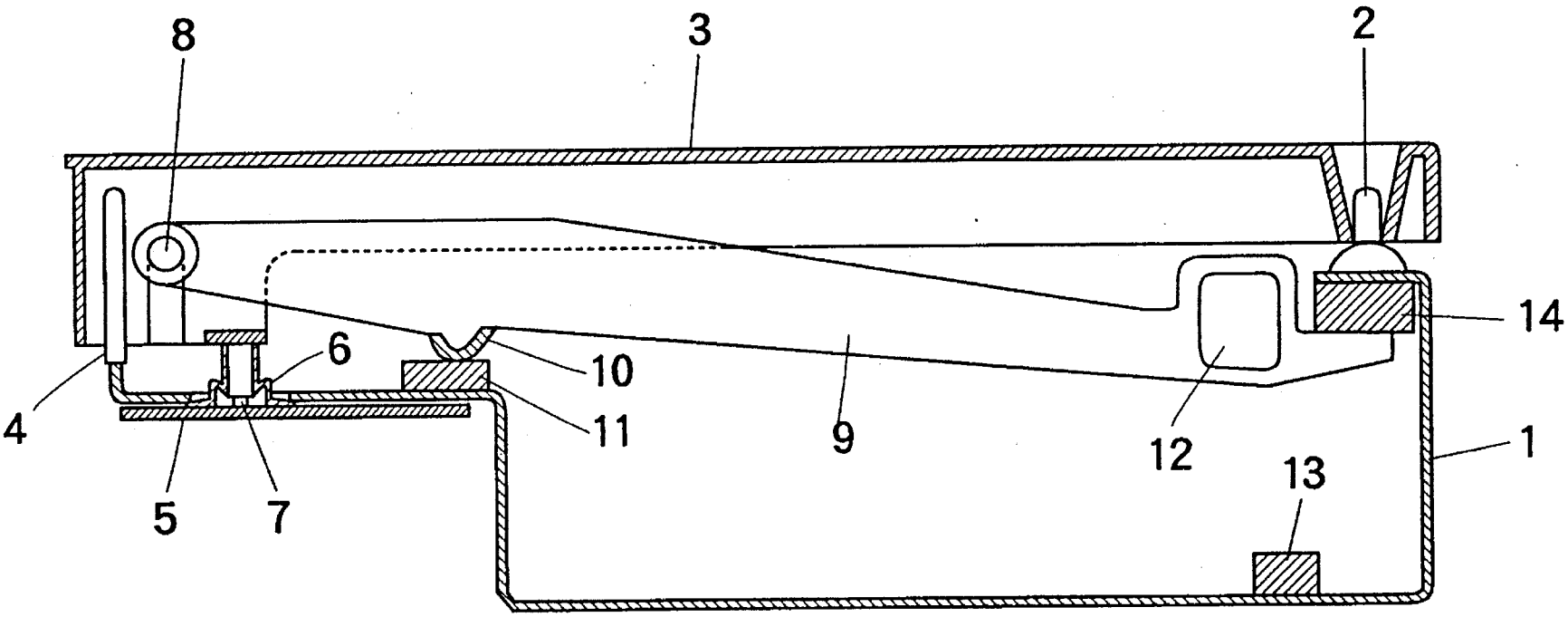
FIG. 2 is a sectional diagram showing the same embodiment where the key is placed in a depressed state.

FIGS. 1 and 2 show one embodiment of the inventive keyboard apparatus. More specifically, FIG. 1 illustrates a rest state of a key, and FIG. 2 illustrates a depressed state of the same key where the key reaches a lower limit of a stroke movement. The keyboard apparatus is constructed on a frame 1 having a support member 2 at a rear and portion of the frame 1. A key 3 is pivotably supported by the support member 2 to undergo a pivotal primary stroke movement in a vertical direction as indicated by a double-headed arrow A in response to a finger action applied to a free end portion of the key 3. The support member 2 is constructed not only to allow the pivotal primary stroke movement of the key 3 upward and downward in the vertical direction, but also to allow an adjustive pivotal displacement of the key 3 leftward and rightward in the horizontal direction. A guiding member 4 is provided at a front end portion of the frame 1 to guide the primary stroke movement of the key 3 in the vertical direction. The guiding member 4 is inserted inside the front free end portion of the key 3, such that opposite side edges of the guiding member 4 are placed in slide contact with confronting inner side walls of the key 3 to guide the stroke movement along the inner side walls.

A switch substrate 5 composed of a printed circuit board is attached to a bottom of the front portion of the frame 1. A key switch 6 composed of elastic material such as rubber is mounted on the switch substrate 5. The key switch 6 protrudes upward through an opening formed in the frame 1. The key switch 6 contains a movable contact piece 7. As shown in FIG. 2, when the key 3 is depressed by a forward finger action, the key switch 6 is pushed downward by an acting portion of the key 3 so that the movable contact piece 7 comes into contact with a stationary contact pattern printed on the switch substrate 5 to thereby produce a key-on signal effective to control an electronic musical instrument to perform a musical play in response to a finger action.

A mass member in the form of a hammer 9 is linked to the key 3 through a pivot shaft 8 to undergo a pivotal secondary stroke movement as indicated by a double headed arrow B in response to the pivotal primary stroke movement of the key 3. The hammer 9 is composed of hard plastics or metal materials. The hammer 9 functions as a lever which has an intermediate fulcrum protrusion 10 disposed at a bottom of the hammer 9 and positioned closer to the linked front end as compared to a rear free end of the hammer 9. The fulcrum protrusion 10 is slidably supported on a bearing member 11 disposed on the frame 1 such that the hammer 9 can slide horizontally along the bearing member 11 as indicated by a double headed arrow C, to ensure the smooth secondary stroke movement. A weight 12 is attached to the free rear end portion of the hammer 9.

A pair of stoppers 13 and 14 composed of felt material are disposed on the frame 1 in registration with opposite sides of the free end portion of the hammer 9. The first stopper 13 is positioned not only to directly fix a lower limit of the secondary stroke movement of the hammer 9, but also to indirectly fix an upper limit of the primary stroke movement of the key 3. The second stopper 14 is positioned not only to directly fix an upper limit of the secondary stroke movement of tile hammer 9, but also to indirectly fix or determine a lower limit of the primary stroke movement of the key 3. In such a lever structure of the hammer 9, one arm length L1 between the pivot shaft 8 and the bearing member 11 and another arm length L2 between the stopper 13 and the bearing member 11 are set in the ratio of about 1:3 in order to impart a sufficient dynamic reaction to the finger action in the key depressing operation.

In operation of the keyboard apparatus having the above described construction, a forward finger action is applied to the free end portion of the key 3 which is held in the rest or home state of FIG. 1. Consequently, the key 3 is depressed to undergo the pivotal primary stroke movement around the supporting member 2 while the guiding member 4 guides the key 3 in the vertical direction. The pivot shaft 8 of the hammer 9 accordingly moves downward with the downward stroke movement of the key 3. With the downward displacement of the pivot shaft 8, the fulcrum protrusion 10 slides rearward along the bearing member 11. Concurrently with the sliding displacement, the hammer 9 rotates counterclockwise around the pivot shaft. 8 to undergo the secondary stroke movement upward by lever operation at the fulcrum protrusion 10. Consequently, the free end portion of the hammer 9 removes away from the first stopper 13 to rise toward the second stopper 14 while lifting the weight 12 of the hammer which can generate the dynamic reaction. The key 3 is continuously depressed under the dynamic reaction so that the free end portion of the hammer 9 lastly abuts with the second stopper 14 to thereby stop the upward stroke movement. Consequently, the key 3 is locked by means of the lever links to stop the downward stroke movement. By such a manner, the second stopper 14 directly fixes or determines the upper limit of the upward secondary stroke movement of the hammer 9, and indirectly fixes or determines the lower limit of the downward stroke movement of the key 3 through the lever link between the hammer 9 and the key 3.

Then, the finger action is reversed to release the pressure from the free end portion of the key 3 which is held in the depressed state of FIG. 2. Consequently, the hammer 9 undergoes the spontaneous downward stroke movement due to gravitational force of the weight 12 so that the hammer 9 rotates around the pivot shaft 8 clockwise, while linearly sliding forward along the bearing member 11. Consequently, the hammer 9 returns to the home position to come into abutment with the first stopper 13 at the free end portion of the hammer to thereby stop the downward stroke movement. Concurrently with this, the key 3 stops the upward stroke movement to restore the rest state of FIG. 1. By such a manner, the first stopper 13 directly fixes the lower limit of the downward secondary stroke movement of the hammer 9, and indirectly fixes the upper limit of the upward primary stroke movement of the key 3. Thus, the pair of the first and second stoppers 13 and 14 constitute the stopper means not only for directly regulating the secondary stroke movement of the hammer 9, but also for indirectly regulating the primary stroke movement of the key 3. Such a construction can eliminate dislocation and variation of stopper positions which would occur in the conviction structure where separate stoppers arc provided for the key and the hammer, thereby ensuring good and stable key touches at the start and stop of the key depressing operation. Further, as shown in FIG. 1, the stroke of the key 3 is set about one third (⅓) of the other stroke L3 of the hammer 9 according to the lever relation $L3 \times L1/L2 = L3/3$. Generally, a thickness error of the felt material of the stopper most affects a position and a range of the key stroke. Such an affect of the thickness error can be reduced by one third, thereby improving the stroke accuracy.

Figure 10A:
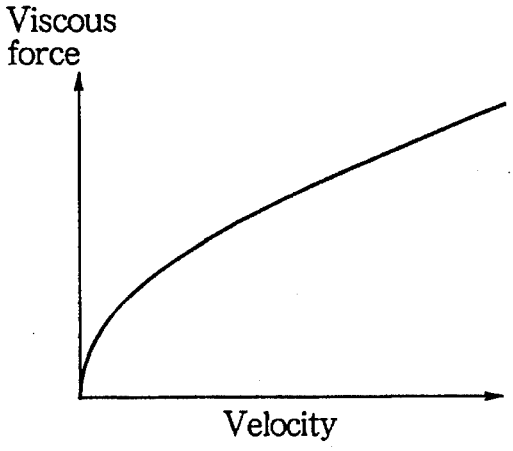
FIG.10A PRIOR ART
FIG. 10A is a graph showing a viscous force/velocity characteristic of grease.
Figure 10B:
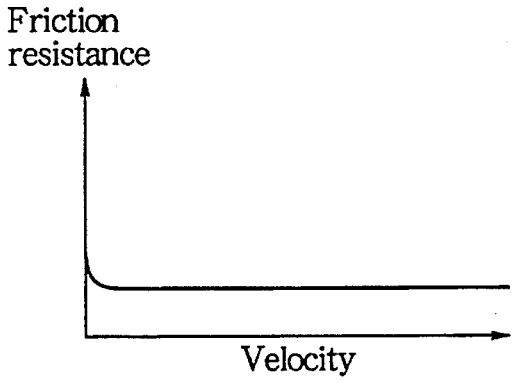
FIG. 10B is a graph showing a friction resistance/velocity characteristic of bearings.
Figure 10C:
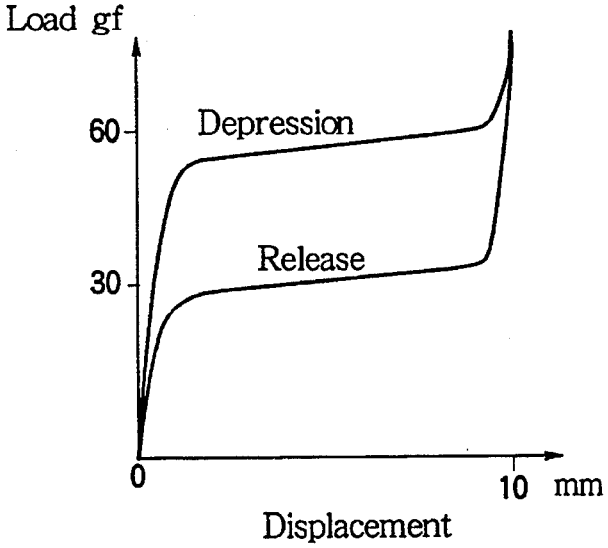
FIG. 10C is a graph showing a load/displacement characteristic of a hammer.

More importantly in the above described embodiment, the hammer 9 is formed with the fulcrum protrusion 10 which is linearly slideably supported by the bearing member 1 1 disposed on the frame 1. Such a slide bearing structure can impart a hysteresis to a key load to improve key touches at the depression and release as well as to ensure quick return of the key to improve repeatability of the key striking. Such a feature will be described in more detail in conjunction with FIGS. 10A, 10B and 10C. Generally, the dynamic load hysteresis is generated to differentiate the forward load resistance at the key depression and the reverse load resistance at the key release from each other. Such a load hysteresis well simulates natural key touches of an acoustic piano instrument. Conventionally, a viscous grease is applied to the key to generate the load hysteresis. However, as shown in FIG. 10A, the viscous grease exhibits dependency of a viscous forth on a velocity. The viscous force increases as the velocity increases. By this, a greater viscous force is generated during a faster return of the key as compared to a slower depression of the key to thereby adversely suppress a return velocity of the key, which would hinder the repeatability of the key striking. In contrast, in the inventive keyboard construction, the hammer is utilized for improving mass feeling of the key, and the hammer is slideably supported by the horizontal bearing member. As shown in FIG. 10B, a friction resistance of such a slide bearing structure is substantially held constant regardless of the velocity of the key movement. Therefore, a quick return of the hammer does not increase the resistance during the release operation of the key. Consequently as indicated by a dynamic load characteristic of FIG. 10C, the mass feeling is enhanced due to the inertial load of the hammer in the key depression, while the key spontaneously returns to the home position by the gravitational weight of the hammer to reduce a dynamic load in the key release. By such an operation, the hysteresis loop is formed to improve the key touches, and to improve the repeatability of the key striking since the key can quickly return because the friction resistance is not raised in the return operation of the key. The dynamic load characteristic of FIG. 10C shows a relation between the dynamic load of the hammer and the displacement of the key when the key is depressed at a velocity of 10 cm/min. Preferably, the bearing member 11 may be composed of felt material or else which can produce an adequate fiction when the fulcrum protrusion 10 of the hammer 9 slides along the bearing member 11. Such an adequate friction resistance can enhance the mass feeling of the key depression to thereby improve the key touch.

Further, in the disclosed embodiment, the supporting member engaged at the rear end portion of the key pivotably supports the key upward and downward in the vertical direction, but also the supporting member pivotably supports the key to allow an adjustive displacement leftward and rightward in the horizontal direction. By such a support structure, even if the supporting member at the key rear end and the guiding member at the key front end are offset from each other in tile horizontal direction, the key can pivotably displace laterally to follow the offset between the supporting member and the guiding member. Such an adjustive displacement can prevent application of lateral subsidiary stress to the key and the frame, which would otherwise generate noises or hinder durability of the keyboard. Further, the adjustive displacement can reduce an excessive pressure applied to tile supporting member and the guiding member to avoid increase in the rotational and frictional resistances thereof to thereby ensure a uniform and pleasant touches throughout the key array to achieve smooth depressing operation.

Figure 3:
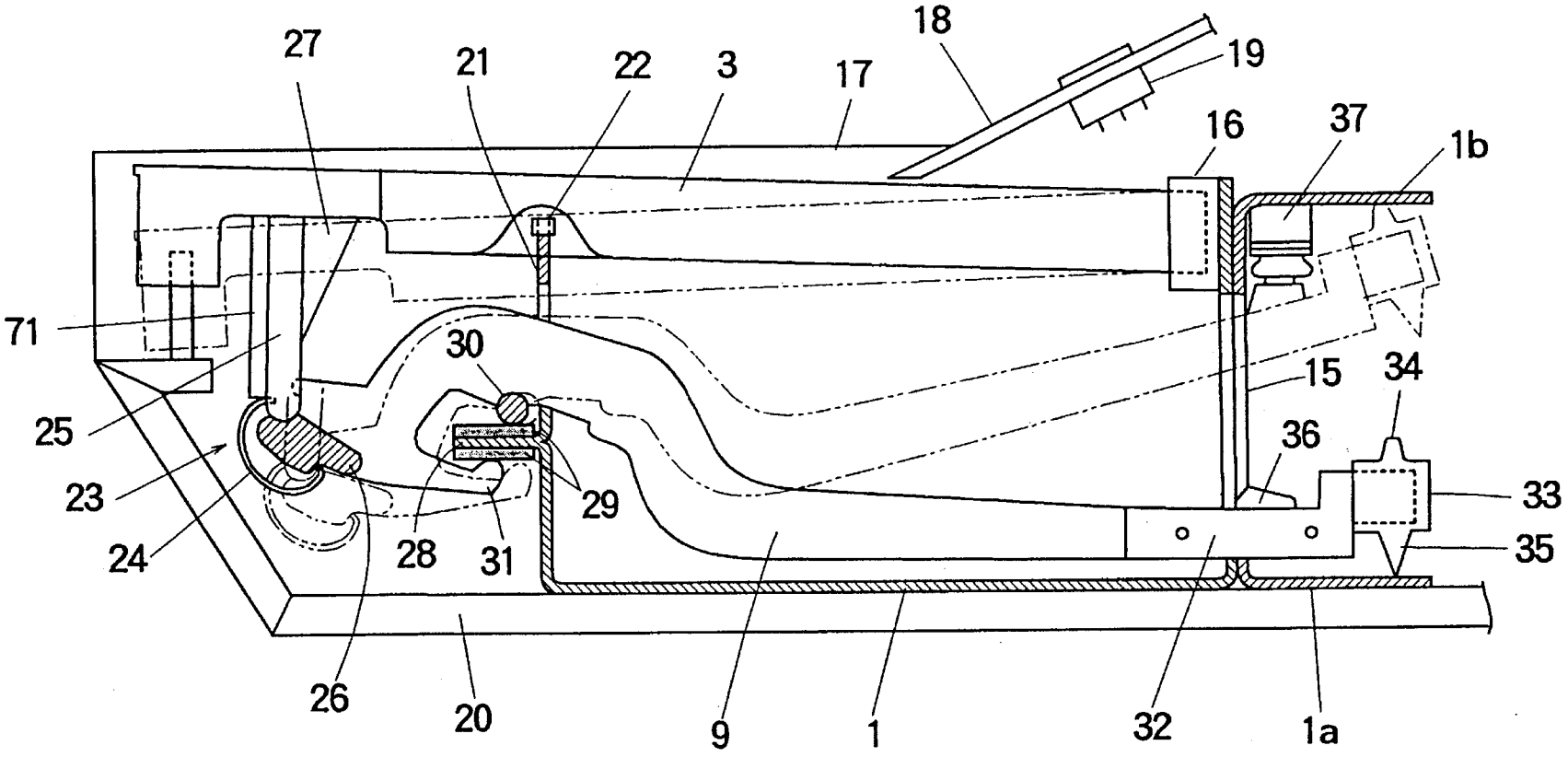
FIG. 3 is a sectional diagram showing another embodiment of the inventive keyboard apparatus.

FIG. 3 shows another embodiment of the inventive keyboard apparatus. A supplementary frame 15 is attached to a rear end of a main frame 1. A hammer 9 composed of hard plastics or suitable metal materials is disposed into openings formed in tile main frame 1 and the supplementary frame 15. A supporting member 16 is fixed to an upper part of the rear portion of the main frame 1 for supporting a rear end of a key 1. The supporting member 16 is constructed not only to pivotably support the key 3 in the vertical direction, but also to rotatably support the key 3 in the horizontal direction to leave an adjustive play, while avoiding a subsidiary torsional displacement of the key. The keyboard is accommodated in an electronic musical instrument which is enclosed by a side plate 17, an operating panel 18 provided with timbre select switches 19 and other operating switches, and a bottom plate 20.

A front portion of the main frame 1 is segmented and elected upright to form a guide post 21 corresponding to each of the keys 3. A guide ring 22 is fitted into a top end of the guide post 21 to constitute a guide member. The guide ring 22 is placed in contact with opposed inner faces of the key 3 to guide the primary stroke movement of the key 3. In this guide structure, the guide ring 22 is shaped in point contact with the inner faces of the key 3. The point contact means that the guide ring 22 need not have a substantial vertical length to suppress a torsional dislocation of the key 3. In a typical keyboard, the guide ring 22 may have a vertical length less than 8 mm to achieve the point contact. Such a point contact guiding structure is realized because the supporting member 16 is constructed to prevent the torsional displacement of the key 3 instead of the guiding member. The guide member is shaped in point contact so that its vertical length along the guiding direction can be reduced significantly as compared to the prior art. By such a construction, an overall thickness of the keyboard apparatus can be reduced, while the stroke of the hammer can be expanded. Consequently, an actual weight of the hammer can be saved because a dynamic inertial mass is increased due to the expanded hammer stroke, while maintaining a good dynamic key touch. In modification, the guide post 21 having the point guide ring 22 may be positioned at a top end portion of the key 3 as indicated by the dotted line.

The key 3 and the hammer 9 are coupled to each other by means of a link mechanism 23. The link mechanism 23 includes a coupling spring 24 which couples an actuating member 25 attached to tile key 3 and an operating member 26 provided at one end of the hammer 9 with each other. A rib 27 is disposed to reinforce the actuating member 25. A weight 71 is provided to adjust a mass of the key 3. The operating member 26 is formed integrally with a body of the hammer 9 at the top thereof, and is shaped thicker laterally than the hammer body to secure the coupling between the hammer 9 and the key 3. The actuating member 25 has also a thick lateral width correspondingly to the thickness of the operating member 26 to expand a contact area between the actuating member 25 and the operating member 26 to ensure the link operation. The sliding contact area between the actuating member 25 and the operating member 26 has an arc shape such that a tip end of the actuating member 25 is shaped in a cylindrical convex face and a receiving portion of the operating member 26 is shaped in a concave face in matching with the convex face of the actuating member 25. The convex face of the actuating member 25 is rotatably engaged with the concave face of the operating member 26. The coupling spring 24 reisilently and pressively couples the actuating member 25 and the operating member 26. In this embodiment, the coupling spring 24 is composed of a curved leaf spring having opposite ends which are bent to engage with the actuating member 25 and the operating member 26. By such a link structure, when the coupled actuating member 25 and the operating member 26 are moved together in response to the stroke movement of the key 3, the convex face of the actuating member 25 can be rotatably slid along the concave face of the operating member 26 without backlash or play because the actuating member 25 and the operating member 26 are coupled resiliently under pressure by the spring 24.

A bearing member 28 is integrally formed on the frame 1. The bearing member 28 is sandwiched by a pair of upper and lower felt materials 29. Further, a pair of fulcrum protrusions 30 and 31 are integrally formed on the hammer 9, and sandwich the bearing member 28 through the upper and lower felt materials 29. The upper fulcrum protrusion 30 is formed as a part of the hammer 9, and is shaped in a cylindrical form having a length greater than the width of the hammer 9 in manner similar to the operating member 26. By such a construction, the upper fulcrum protrusion 30 can smoothly and firmly slide linearly along the bearing member 28 under a certain pressure without backlash or irregular contact. Upon application of a depressing force to the operating member 26 by means of the actuating member 25, the hammer 9 undergoes the pivotal stroke movement around the fulcrum protrusion 30 by lever action, while linearly shifting over the bearing member 28.

A weight 32 composed of iron or other metals is fixed to the rear end of the hammer 9. The weight 32 can add an inertial load effective to increase a heavy mass feeling upon the key depression to thereby improve a dynamic key touch. Further, upon the key release, the hammer 9 smoothly and quickly rotates to return by the gravitational force of the weight 32. A contact piece 33 composed of rubber or other elastic materials is attached to the rear end of the hammer 9. A pair of protrusions 34 and 35 having a conical shape arc formed at top and bottom ends of the contact piece 33. The top protrusion 34 comes into contact with an upper stopper segment **1*b* of the supplementary frame 15 attached to the rear end of the main frame 1 upon the key depression, while the bottom protrusion 35 comes into contact with a lower stopper segment 1*a* of the supplementary frame 15 upon the key release. The pair of the lower and upper stopper segments 1*a* and 1*b* fix the lower and upper limits of the secondary stroke movement of the hammer 9. The contact protrusions 34 and 35 have the conical shape so that the hammer 9 never stop suddenly when abutting with the stopper segment, but the protrusions 34 and 35 gradually deform to absorb a shock of the abutment so that the hammer 9** softly stops with a slight delay. Such a construction can improve key touches at the start and stop of the key depression. In modification, felt or other soft materials may be attached to the upper and lower stopper segments*b* and **1*a* of the supplementary frame 15 so as to receive the protrusions 34 and 35 of the contact piece 33. Alternatively, the contact piece 33 of the hammer 9 may be formed of hard materials, while elastic materials may be provided on the upper and lower stopper segments of the frame. An actuator 36 is disposed at the rear end portion of the hammer 9. A sensor 37 is positioned oppositely to the actuator 36 at the bottom face of the upper stopper segment 1*b* of the supplementary frame 15. The sensor 37 has an outer body composed of elastic material. The actuator 36 comes into contact with the sensor 37 when the rear end of the hammer 9 rises to reach the upper limit upon the key depression, thereby pressing the outer body of the sensor 37 to elastically deform the same to actuate the sensor 37. The sensor 37 is comprised of a mechanism switch having stepwise double contacts of a coaxial structure such that the double contacts are sequentially closed upon the abutment with the actuator 36 so as to measure a time difference between the double contacts to detect a velocity of the stroke movement of the hammer 9. The detected results may be utilized to control tone generation of the electronic musical instrument. In modification, the sensor 37** may be composed of a photoreflector, or a simple on/off switch having a single contact.

Figure 4:
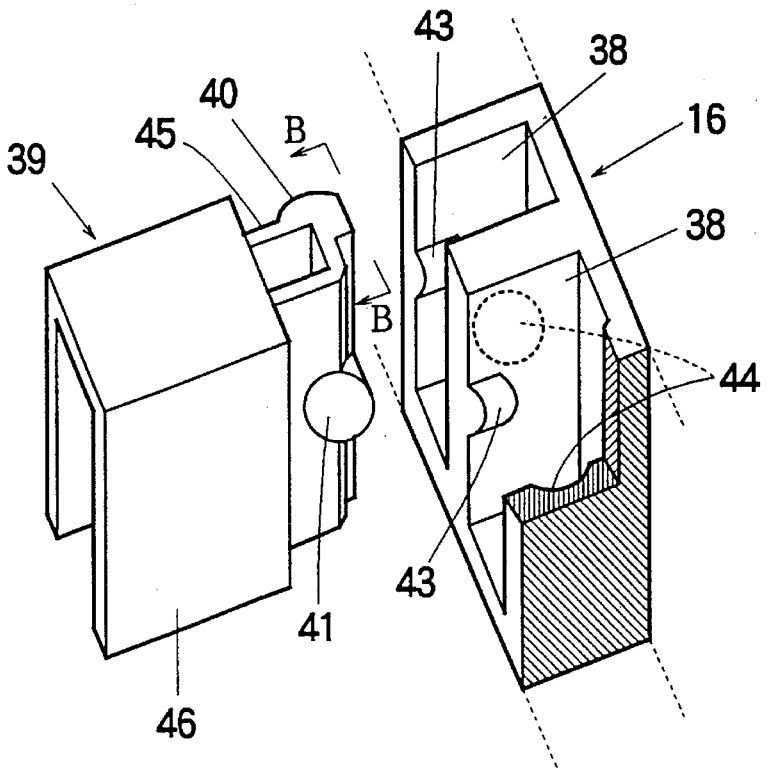
FIG. 4 is a perspective diagram showing a pivotal support structure of key in the FIG. 3 embodiment.
Figure 5:
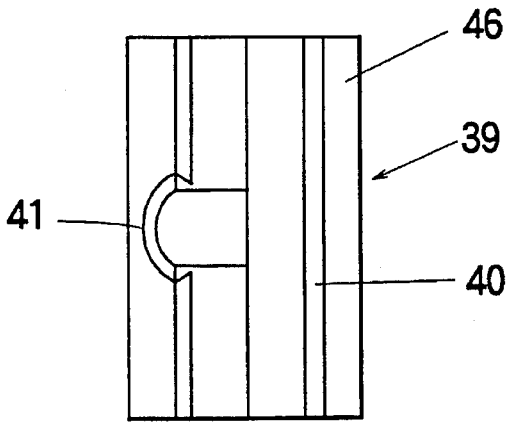
FIG. 5 is a side view taken in the direction B—B of FIG. 4.
Figure 6:
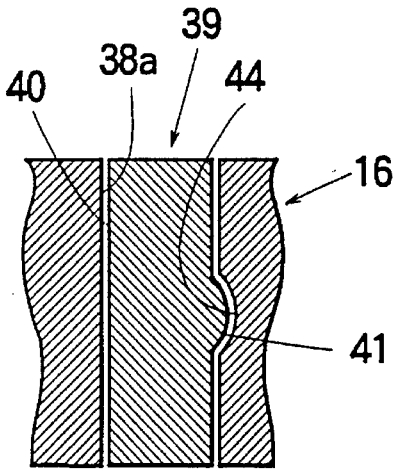
FIG. 6 is a partial section showing a coupled state of the FIG. 4 support structure.

FIG. 4 is a exploded diagram showing a pivotal support construction containing the supporting member 16 for supporting the rear end of the key 3. FIG. 5 is a side diagram viewed from the line B–B of FIG. 4. FIG. 6 is a sectional diagram showing an essential part of the assembled support construction. A joint member 39 is attached to the rear end of the key (FIG. 3). The joint member 39 is fitted into the supporting member 16 disposed on the frame. The joint member 39 has a fitting part 46 which firmly receives the rear end of the key 3. Otherwise, the joint member 39 may be integrally formed as a rear end part of the key. A vertical groove 45 and an adjacent cylindrical protrusion 40 are formed on a rear end of the fitting part 46. A spherical protrusion 41 is also formed on the same rear and at an opposite side to the cylindrical protrusion 40.

The supporting member 16 has an array of recesses 38, each of which receives the joint member 39 of the key. The cylindrical protrusion 40 is pressed into the corresponding recess 38 over a protrusion 43 formed at an entrance portion of the recess 38. Consequently, the protrusion 43 is fitted into the groove 45 of the joint member 39 to prevent dropping of the key. At the opposite side, the spherical protrusion 41 is freely and slidably fitted into a spherical notch 44 formed at an inner side of the recess 38.

Under the coupled state of the joint member 39 of the key 3 with the supporting member 16 of the frame 1, a slight clearance is left between a rear shoulder (rear face) of the fitting part 46 of the joint member 39 and a front edge of the supporting member 16, and another slight clearance is left between a rear face of the cylindrical protrusion 40 and an opposed inner end face of the recess 38. These clearances allow the key to undergo the primary stroke movement upward and downward in the vertical direction. Namely, the key 3 (FIG. 3) can be pivoted up and down around the spherical protrusion 41 of the joint member 39 which is fitted into the spherical notch 43 of the supporting member 16 in free sliding manner. Further, in the above support construction, the cylindrical protrusion 40 of the joint member 39 is supported rotatably around a cylindrical axis in the inner faces of the recess 38 of the supporting member 16, while the spherical protrusion 41 of the joint member 39 is freely supported by the spherical notch 44 of the supporting member 16. Consequently, the key 3 is allowed to undergo an adjustive lateral displacement pivotably in the horizontal direction relative to the frame 1 within a clearance left between the rear shoulder of the fitting part 46 and the front edge of the supporting member 16.

Referring to FIG. 6, the description is given for a torsional displacement blocking mechanism of the above pivotal support structure. FIG. 6 is a vertical sectional diagram taken along the cylindrical protrusion 40 and the spherical protrusion 41 under tile coupled state where the joint member 39 is fitted into the supporting member 16. With respect to a rotational displacement around a lengthwise axis of the key 3 (which is normal to the drawing sheet), for example, when a clockwise torque is applied to the key 3 in the FIG. 6 construction, the joint member 39 tends to rotate in the clockwise direction. However, in response to the clockwise torque, a lower edge of tile cylindrical protrusion 40 of the joint member 39 comes into abutment with a lower edge of an inner vertical face 38*a* of the recess 38 of the supporting member 16, while the spherical protrusion 41 is pressed against the spherical notch 44 at the opposite side, thereby suppressing clockwise torsional displacement of the key. On the other hand, if a counterclockwise torsional stress is applied to the key 3, the joint member 39 tends to rotate counterclockwise. However, in response to the torsional stress, an upper edge of tile cylindric protrusion 40 comes into abutment with an upper edge of the recess inner face 38*a*, while the spherical protrusion 41 is pressed against the spherical notch 44, thereby blocking a counterclockwise torsional displacement of the key.

The inventive keyboard apparatus employs the above support structure effective to suppress or prohibit the subsidiary torsional displacement of the key, hence the guiding member does not need a lengthy vertical contact face but can be shaped in substantial point contact with inner faces of the key so as to guide the primary stroke movement of the key. The guiding member of the point contact type can be shaped by rather rough working, while leaving great freedom of design for other parts. Further, in a complicated keyboard apparatus having a limited space for the movement of the hammer, the vertical thickness of the key guide portion can be reduced. The support structure having the torsional dislocation blocking mechanism is efficiently combined with the hammer structure having the single stopper effective to indirectly control the key stroke, so as to further reduce the vertical thickness of the keyboard as small as possible.

Figure 7:
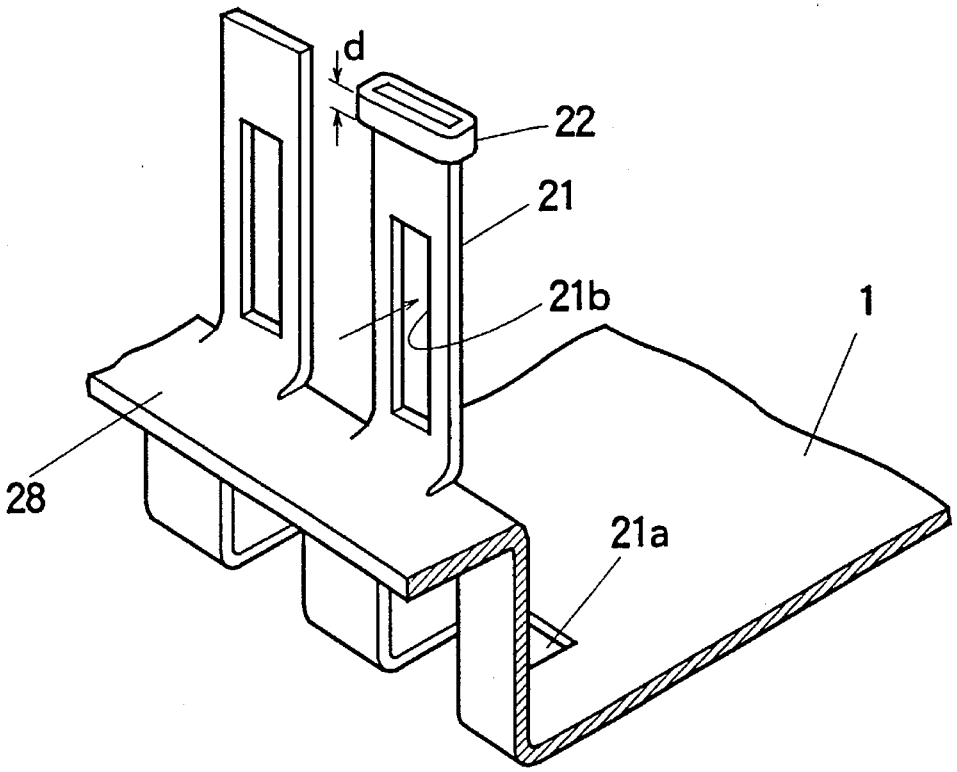
FIG. 7 is a partial perspective diagram showing a front end portion of a frame used in the FIG. 3 embodiment.

FIG. 7 is a perspective view showing a front part of the frame 1 used in the FIG. 3 embodiment. As shown in the figure, the front part of the frame 1 is cut correspondingly to the keys, and each cut portion is elected upright to form the guide post 21 while leaving a recess 21*a*. An opening 21*b* is formed in the guide post 21 for passing a corresponding hammer. As indicated by the arrow, the hammer 9 (FIG. 3) is inserted into the opening 21*b* for the assembling. The bearing member 28 is integrally formed at the front part of the frame 1. The bearing member 28 is sandwiched by the pair of upper and lower felt materials 29 (FIG. 3), which slideably receive thereon the fulcrum protrusions 30 and 31 of the hammer 9.

The guide ring 22 composed of polyurethane or other soft plastics is attached to the tip end of the upright guide post 21. As described before, the rear support member effectively blocks the torsional dislocation of the key, hence the guide ring 22 may simply regulate or guide the lateral position of the key. Namely, the torsion blocking function of the rear support member cooperates with the lateral position guiding function of the front guide ring 22 so as to smoothly guide the vertical pivot stroke of the key. Consequently, the thickness d of the guide ring 22 is significantly reduced to form the guide member having a substantial point contact structure.

Figure 8:
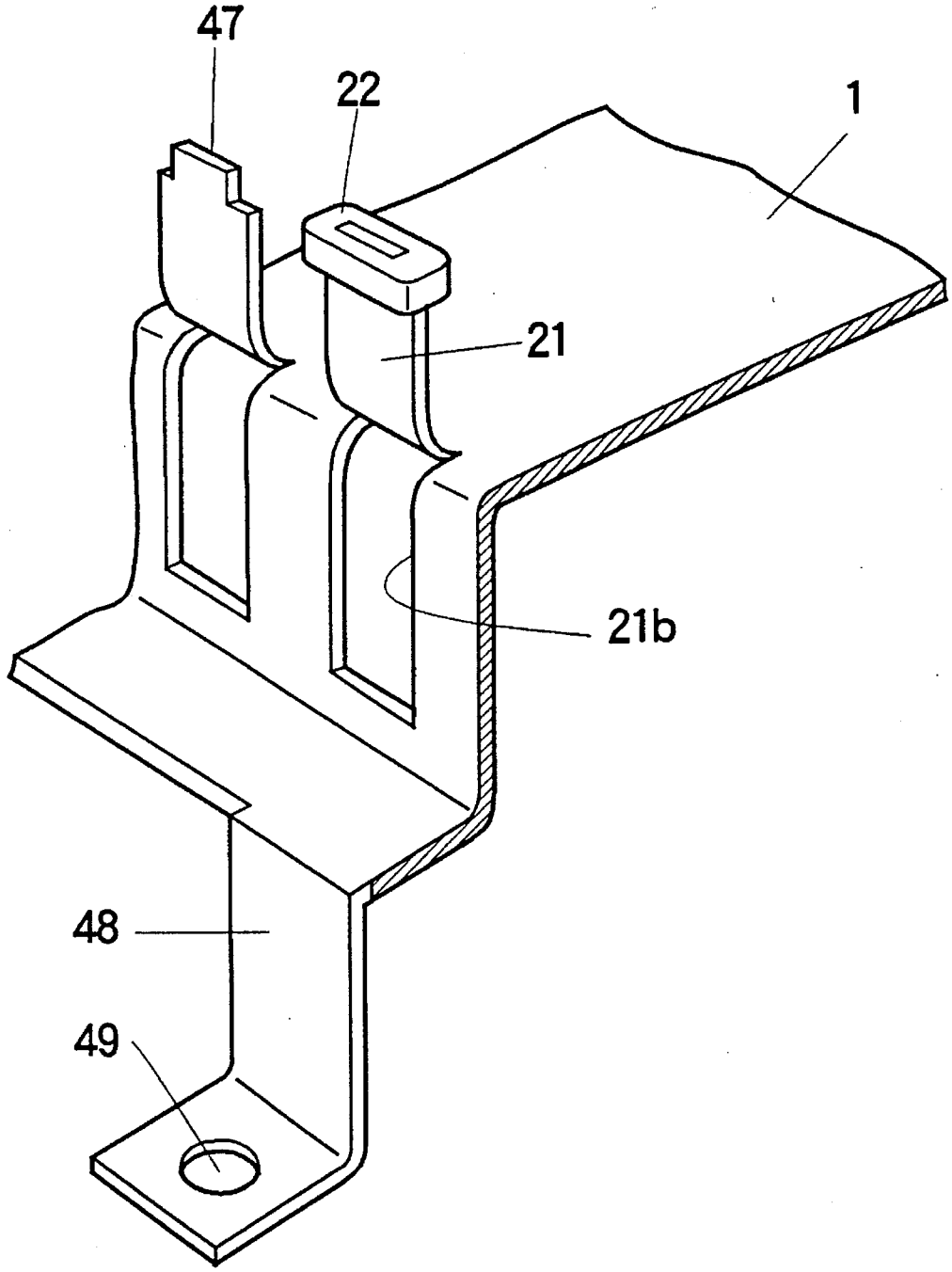
FIG. 8 is a partial perspective diagram showing another frame.

FIG. 8 is a perspective view showing another example of the frame 1. The frame 1 has a leg section 48 disposed at a given interval corresponding to a half octave or a whole octave for fixing the frame 1 to the bottom or base plate 20 (FIG. 9) of the electronic instrument. The leg section 48 is formed with a fitting hole 49 coupled to the base plate. The guide post 21 is cut and folded upright to leave the recess 21*b* utilized to receive therethrough the hammer (not shown). Such a construction eliminates the opening 21*b* which is formed in the FIG. 7 example for receiving the hammer, thereby facilitating working of the frame and saving the material of the frame. A pair of step shoulders 47 are formed at the tip end of the elongated guide post 21. The guide ring 22 of the point contact type is fitted into the step shoulders 47. Such a shoulder 47 facilitates the fitting work of the guide ring 22.

Figure 9:
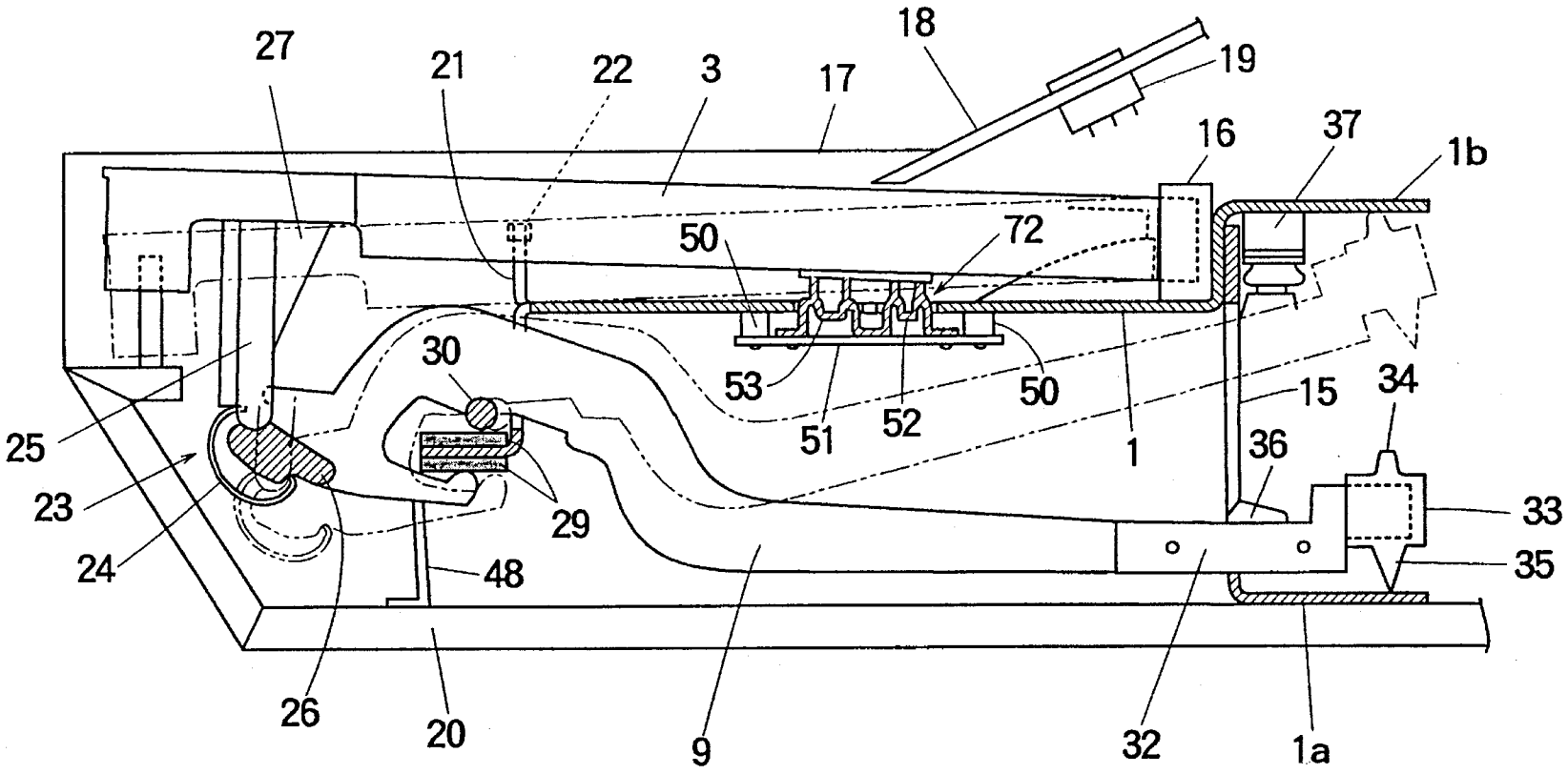
FIG. 9 is a sectional diagram showing a further embodiment of the inventive keyboard apparatus which utilizes the frame shown in FIG. 8.

FIG. 9 is a vertical section showing a further embodiment of the inventive keyboard apparatus. The present embodiment is constructed on the frame 1 shown in FIG. 8. The frame 1 is disposed substantially under the key 3 and above the hammer 9 so that the frame 1 can mount thereon switches or sensors actuated by the key 3. In this embodiment, a switch substrate 51 is attached under an intermediate portion of the frame 1 by means of spacers 50. The switch substrate 51 mounts thereon a switch 72 of a two-make type composed of elastic material and having first and second movable contacts 52 and 53. A top part of the switch 72 protrudes upward through a hole formed in the frame 1. Preferably, a leaf spring SP is added as coupling means for firmly coupling the key 3 and the support member 16 with each other to prevent, the key 3 from dropping off the support member 16. The leaf spring SP is engaged between the frame 1 and the rear end portion of the key 3 to urge the same against the support member 16. In this regard, the protrusion 43 (FIG. 4) provided in the support member 16 also constitutes another coupling means for coupling the key 3 and the support member 16 to prevent the key 3 from dropping off the support member.

In operation, upon the key depression, the key 3 presses the switch 72 to elastically actuate the same. Initially, the first movable contact 52 comes into abutment with a corresponding stationary contact formed on the switch substrate 51 to close a first contact pair, and subsequently the second movable contact 53 comes into abutment with another stationary contact formed on the substrate 51 to close a second contact pair. Such a switch 72 of the two-make type can efficiently detect the key movement to generate key-on and key-off signals or a velocity signal based on a time difference between the two contact pairs. The key switch means composed of the two-make switch 72 directly actuated by the key 3 cooperates with the key sensor 37 actuated by the hammer 9 to accurately detect not only the stroke position of the key 3 but also the pressure, the velocity, the fine vibration and other states of the key, thereby achieving delicate control of musical tones. Other constructions and functions are similar to those of the FIG. 3 embodiment.

Figure 11A:
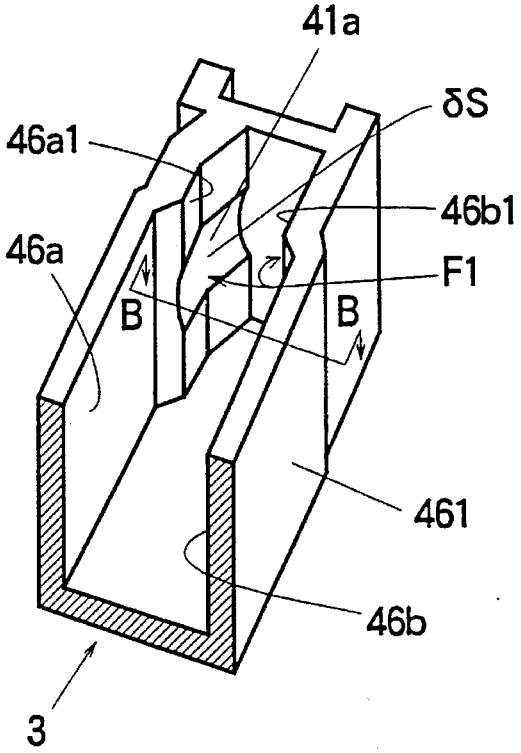
FIG. 11A–11D show another embodiment of the pivotal support structure of key.
Figure 11B:
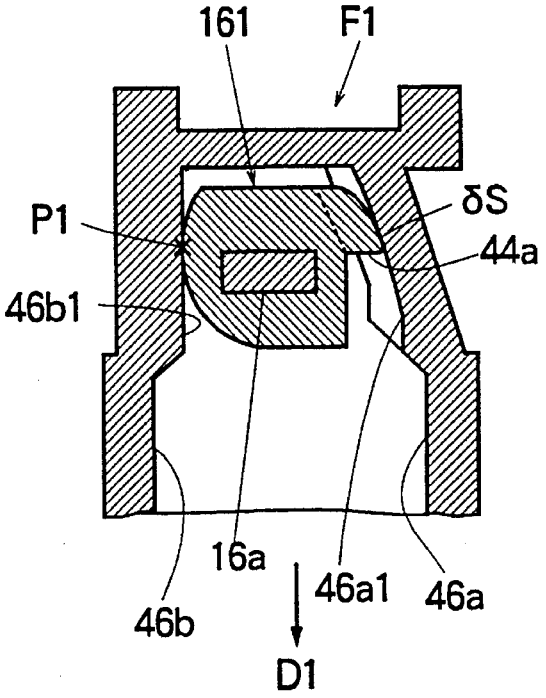
Figure 11C:
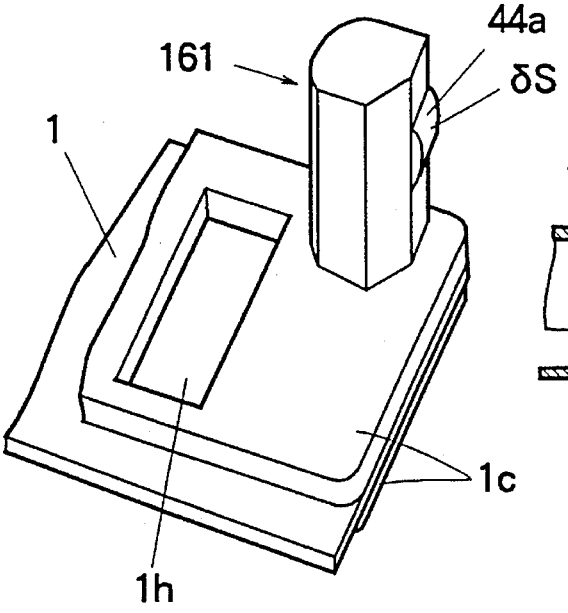
Figure 11D:
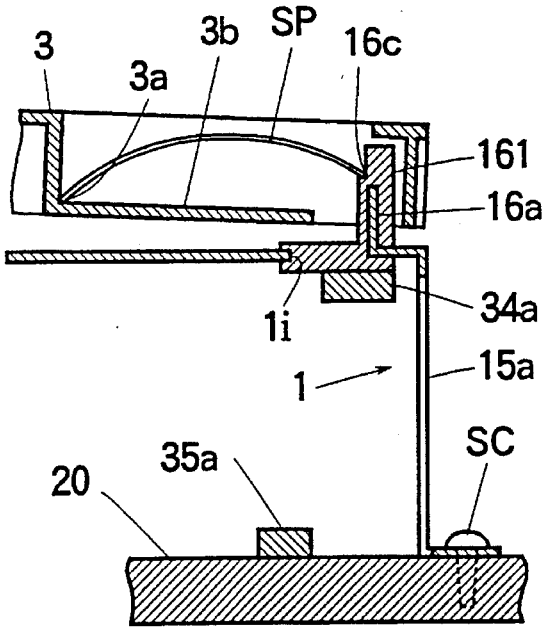

In the above described embodiments shown in FIGS. 3, 4, and 9, the convex joint member 39 is provided at the rear end of the key 3, while the concave support member 16 is disposed on the frame 1. However, these convex and cave members can be interchanged with each other. FIGS. 11A–11D show such an embodiment. FIG. 11A is a bottom view of a rear end portion of a key 3. FIG. 11B is a sectional view of the key support structure, taken along line B—B of FIG. 11A. FIG. 11C is a front perspective view of a frame 1 which supports a key. FIG. 11D is a vertical section showing a coupled state of the key 3 (FIG. 11A) and the frame 1 (FIG. 11 C).

In the present embodiment, a convex part 161 is elected on the frame 1, while a corresponding concave part F1 is formed at the rear end of the key 3. The concave part F1 has a pair of inner side faces 46*a*1 and 46*b*1 along side walls 461 of the key 3. The inner side faces 46*a*1 and 46*b*1 are laterally opposite to each other in a widthwise direction, and they come to close with each other toward the rear end of the key 3. The one inner side face 46*a*1 has a recess 41*a*, while the other inner side face 46*b*1 has a flat plane. The recess 41*a* has a bottom center line in a sectional plane taken in parallel to a top face of the key 3. The bottom center line may be preferably a folded line, a circular line, an elliptical line, or even a straight line. In the last case, the recess 41*a* should be tapered toward the rear end and directed toward the center of the key. The recess 41*a* may be shaped into a generally semi cylindrical form.

The convex part 161 is composed of a core 16*a* which is a segment cut out and elected from the frame 1 formed of metal, and which is molded by resin. The resin is outserted to cover top and bottom faces of a common area 1*c* of the frame 1 which connects all of the cores 16*a*. The convex part 161 has a pair of outer side faces which are opposite to each other in the lateral or widthwise direction. The left outer side face is shaped into closed loop vertical protrusion such as a generally semicylindrical protrusion. The right outer side face is shaped also into a closed loop vertical protrusion such as a prismatic protrusion or a semicylindrical protrusion, which has centrally a spot protrusion such as a generally semispherical protrusion or an oval protrusion. A window 1h is formed in the metal frame to partly expose the same between adjacent key or at a pitch corresponding to every two or three keys. The resin can flow in the outsert process along top and bottom faces of the frame 1 through a cut hole 1*i* from which the core 16*a* is cut and elected.

Referring specifically to FIG. 1 1D, a back portion of the frame 1 is formed with an opening 15*a* which passes a mass member (not shown). The back portion of the frame 1 is foxed to a base 20 or a bottom plate of a musical instrument casing by means of a screw SC. An upper stopper 34a composed of urethane rubber or felt is disposed under the outserted portion of the resin to determine an upper stroke limit of the hammer. A singular lower stopper 35*a* is disposed on the base 20 to determine a lower stroke limit of the hammer. These stoppers 34*a* and 35*a* can eliminate the top and bottom protrusions 34 and 35 of the hammer 9 shown in FIGS. 3 and 9.

The concave part F1 shown in FIG. 11A is turned up side down, and is fitted into the convex part 161 shown in FIG. 11C such that the key 3 is pivotably supported by means of support means comprised of the concave and convex parts F1 and 161 as shown in FIG. 11D. A leaf spring SP is engaged between a front lower end 3*a* of a hollow portion 3*b* formed in a rear portion of the key 3 and a front edge 16*c* formed on the convex part 161, so as to urge the key 3 forward. In this coupled stage, as shown in FIG. 11B, the concave part F1 is pressed against the convex part 161 in the forward direction as indicated by the arrow D1. In this coupled state, the respective inner side faces 46*a*1 and 46*b*1 of the concave part F1 are placed in contact with the corresponding outer side faces of the convex part 161.

Namely, as shown in FIG. 11B, the fiat plane of the inner side face 46*b*1 is placed in line contact with the generally cylindrical protrusion of the convex part 161 at a point. P1 along a vertical contact line. On the other hand, the generally cylindrical recess 41*a* formed in the other inner side face 46*a*1 is placed in spot contact with the generally spherical protrusion 44*a* at a point δS, because the cylindrical recess 41*a* and the spherical protrusion 44*a* have slightly different curvatures from each other. In modification, an elongated vertical protrusion of the convex part 161 may not be straight, but may be curved so that the contact line between the flat plane of the inner side face 46*b*1 and the elongated vertical protrusion may be also curved.

Figure 12:
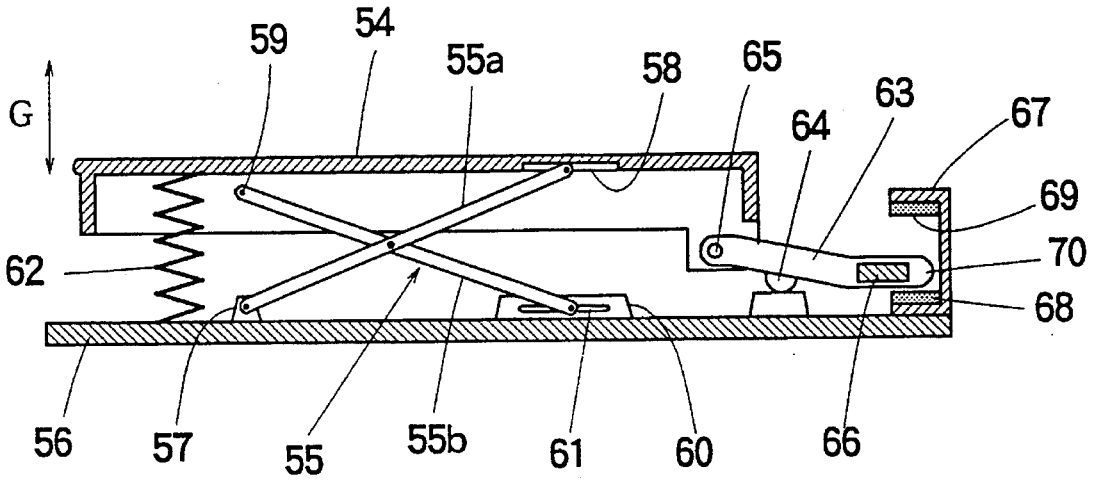
FIG. 12 is a sectional diagram showing a still further embodiment of the inventive keyboard apparatus.

FIG. 12 shows a still further embodiment of the inventive keyboard apparatus. In the prior embodiments, the key undergoes the pivotal stroke movement around the rear support member in response to the finger action. In the present embodiment, the key undergoes a linear stroke movement upward and downward by means of a parallelogram in response to the finger action. A key 54 is supported on a base frame 56 through a parallelogram member 55 which goes up and down like a pantagraph. The parallelogram member 55 is comprised of a pair of link bars 55*a* and 55*b* rotatably connected to each other at their central portions. The one link bar 55*a* is pivotably connected at its lower end to the base support 56 by means of a support pin 57, and is connected at its upper end slideably to a guide groove 58 formed in a top wall of the key 54. The other link bar 55*b* is connected at is upper end pivotably to the key 54 by means of a support pin 59, and is slideably connected at is lower end to a horizontal guide hole 61 of a guide member 60 disposed on the base frame 54. A restoring spring 62 is disposed between the key 54 and the base frame 56.

In operation of the keyboard apparatus utilizing the linking parallelogram member 55, upon the key depression, the key 54 undergoes a downward linear stroke movement against a bias of the spring 62. Upon release of the key depression, the key 54 undergoes an upward linear stroke movement by means of the spring 62 to thereby restore the home or rest position. By such a manner, the key 54 undergoes the parallel stroke movement in response to the forward and reverse finger action as indicated by arrow G. A hammer 63 is engaged with a rear end of the key 54 which undergoes the linear stroke movement upward and downward. The hammer 63 is pivotably linked at its one end to the rear end of the key 54 by means of a rotary shaft 65. A fulcrum protrusion 64 is formed at an intermediate portion of the hammer 63, and is slideably supported on the base frame 56 along the horizontal direction in manner similar to the previous embodiments. A weight 66 is attached to another end 70 of the hammer 63. A stopper support frame 67 is disposed on the base frame 56 in alignment with the rear end 70 of the hammer 63. A pair of upper and lower stoppers 69 and 68 are attached to the support frame 67 in opposed relation to each other for directly fixing upper and lower limits of the secondary pivotal stroke movement of the hammer 63. The operation and function of the hammer 63 is similar to that of the previous embodiments.

As described above, according to the invention, the common stopper is provided not only to directly limit the hammer stroke but also to indirectly limit the key stroke to thereby firmly match the stop positions of the key and the hammer with each other. Such a construction can improve key touches at the start and stop of the key depression, and can ensure pleasant key touches during repeated key striking while maintaining the accurate key stroke. Further, such a stopper structure can eliminate stopper adjustment between the key and the hammer to facilitate assembling work of the keyboard. Moreover, tile felt material does not need to be made thick in order to absorb positional error of stoppers between the key and the hammer. The stopper is not excessively soft to thereby ensure the firm key touches. In addition, a separate stopper of the key is eliminated to thereby save a space. Particularly, the vertical thickness of the keyboard apparatus is reduced to provide a sufficient room over knees of a player. Further, the spot contact between the convex and concave parts of the support member allows the pivotal stroke movement of the key, and the line contact between the convex and concave parts allows the adjustive pivotal displacement of the key, while the combination of the spot and line contacts efficiently suppresses the subsidiary torsional displacement of the same key. Thus, the support structure of the key can prohibit torsional displacement of the key so that the key guide member can be shaped substantially in point contact to significantly reduce a vertical length of the guide faces. Such a guide structure can further reduce the front thickness of the keyboard apparatus.

What is claimed is:

1. A keyboard apparatus comprising:

a plurality of keys arranged such that each key is operable by a finger action to undergo a primary stroke movement;

a plurality of mass members arranged such that each mass member is linked to a corresponding key for undergoing a secondary stroke movement in response to the primary stroke movement of the corresponding key so as to impart a dynamic reaction to the finger action; and stopper means for directly fixing a limit of the secondary stroke movement of each mass member by abutment with the mass member, and for indirectly fixing a limit of the primary stroke movement of the corresponding key through a mechanical link between the key and the mass member.

2. A keyboard apparatus according to claim 1, including guide means comprised of a plurality of guiding members corresponding to respective keys, each guiding member being substantially in point contact with the corresponding key so as to guide the primary stroke movement thereof.

3. A keyboard apparatus according to claim 1, wherein each key comprises a lever member having a free end portion and a fixed end portion pivotably supported such that the lever member undergoes a pivotal primary stroke movement around the fixed end portion in response to the finger action applied to the free end portion.

4. A keyboard apparatus according to claim 3, including support means for supporting the fixed end portion of each key to allow the pivotal primary stroke movement of each key in a vertical direction, and to allow an adjustive pivotal displacement in a horizontal direction, while prohibiting a subsidiary torsional displacement of the same key.

5. A keyboard apparatus according to claim 1, wherein each key comprises a parallelogram member disposed to undergo a linear primary stroke movement upward and downward in response to the finger action.

6. A keyboard apparatus according to claim 1, wherein each mass member comprises a hammer having one end portion linked to the corresponding key, another end portion having a substantial weight, and an intermediate fulcrum portion such that the hammer undergoes a pivotal secondary stroke movement around the intermediate fulcrum portion in response to the finger action indirectly transmitted to said one end portion through the corresponding key to thereby lift the substantial weight and generate the dynamic reaction.

7. A keyboard apparatus according to claim 6, including bearing means disposed for slideably supporting the intermediate fulcrum portion to allow a slide movement of the hammer member.

8. A keyboard apparatus according to claim 1, wherein the mass member has a weight which is lifted by an upward secondary stroke movement in response to a forward finger action, and which is lowered by a downward secondary stroke movement in response to a reverse finger action, thereby generating the dynamic reaction.

9. A keyboard apparatus according to claim 1, wherein the stopper means comprises a plurality of stopper members, each stopper member being positioned to abut with a corresponding mass member when the corresponding mass member reaches the fixed limit of the secondary stroke movement so that a corresponding key is consequently locked when the corresponding key reaches the fixed limit of the primary stroke movement.

10. A keyboard apparatus according to claim 1, including sensor means for sensing the primary stroke movement of each key to generate a key signal in response to the finger action.

11. A keyboard apparatus according to claim 1, wherein a key and a mass member are mechanically linked at a free end of the key.

12. A keyboard apparatus comprising:

a plurality of support members;

a plurality of keys movably supported by the corresponding support members such that each key can be operated by a finger action to undergo a primary stroke movement;

a plurality of mass members arranged such that each mass member is linked to a corresponding key for undergoing a secondary stroke movement in response to the primary stroke movement of the corresponding key so as to impart a dynamic reaction to the finger action;

stopper means for directly fixing a limit of the secondary stroke movement of each mass member by abutment with the mass member, and for indirectly fixing a limit of the primary stroke movement of the corresponding key through a mechanical link between the key and the mass member; and guide means comprised of a plurality of guiding members disposed a predetermined distance from the support members and corresponding to respective keys, each guiding member being substantially in point contact with the corresponding key so as to guide the primary stroke movement thereof.

13. A keyboard apparatus according to claim 12, wherein a key and a mass member are mechanically linked at a free end of the key.

14. A keyboard apparatus comprising:

a plurality of keys each having a front end portion and a rear end portion, and being operable by a finger action applied to the front end portion so as to undergo a stroke movement pivotably around the rear end portion in a vertical direction;

support means for movably supporting the rear end portion of each key, the support means comprising a corresponding pair of a convex part and a concave part which receives therein the convex part, one of the convex part and the concave part being formed at the rear end portion of each key, the convex part having a pair of outer side faces which are laterally opposite to each other and the concave part having a pair of inner side faces which are also laterally opposite to each other, the convex part being fitted into the concave part such that one outer side face and one inner side face are shaped in line contact with each other while another outer side face and another inner side face are shaped in spot contact with each other, thereby the support means allowing the pivotal stroke movement of each key in the vertical direction, and allowing an adjustive pivotal displacement of the same key in a lateral direction, while prohibiting a subsidiary torsional displacement of the same key; and coupling means for firmly coupling the convex part and the concave part with each other.

15. A keyboard apparatus comprising:

a plurality of keys movably supported such that each key can be operated by a finger action to undergo a primary stroke movement;

a plurality of mass members arranged such that each mass member is linked to a corresponding key for undergoing a secondary stroke movement in response to the primary stroke movement of the corresponding key so as to impart a dynamic reaction to the finger action;

stopper means for directly fixing a limit of the secondary stroke movement of each mass member by abutment with the mass member, and for indirectly fixing a limit of the primary stroke movement of the corresponding key through a mechanical link between the key and the mass member; and guide means comprised of a plurality of guiding members corresponding to respective keys, each guiding member being in substantial point contact with one of the corresponding key and the linked mass member so as to guide the primary and secondary stroke movements while suppressing a subsidiary displacement other than the primary and secondary stroke movements.

16. A keyboard apparatus according to claim 15, further including support means for movably supporting each key to allow the primary stroke movement thereof in a vertical direction and to allow an adjustive pivotal displacement thereof in the lateral direction while prohibiting a subsidiary torsional displacement thereof, the support means comprising a corresponding pair of a convex part and a concave part which receives therein the convex part when both parts are coupled to each other, one of the convex part and the concave part being formed at an end portion of each key, the convex part having a pair of outer side faces which are laterally opposite to each other such that one outer side face has a generally semicylindrical protrusion and another outer face has a generally semispherical protrusion, the concave part having a pair of inner side faces which are laterally opposite to each other and which come close to each other toward ends thereof such that one inner side face has a flat plane and another side face has a generally semicylindrical recess, the convex part being fitted into the concave part so that the semicylindrical protrusion is placed in line contact with the flat plane and the semispherical protrusion is placed in spot contact with the semicylindrical recess.

17. A keyboard apparatus according to claim 15, wherein a key and a mass member are mechanically linked at a free end of the key.

18. A keyboard apparatus comprising:

a plurality of keys movably supported such that each key can be operated by a finger action to undergo a primary stroke movement;

a plurality of mass members arranged such that each mass member is linked to a corresponding key for undergoing a secondary stroke movement in response to the primary stroke movement of the corresponding key so as to impart a dynamic reaction to the finger action;

stopper means for directly fixing a limit of the secondary stroke movement of each mass member, and for indirectly fixing a limit of the primary stroke movement of the corresponding key;

guide means comprised of a plurality of guiding members corresponding to respective keys, each guiding member being in substantial point contact with one of the corresponding key and the linked mass member so as to guide the primary and secondary stroke movements while suppressing a subsidiary displacement other than the primary and secondary stroke movements;

support means for pivotably supporting each key, the support means comprising a corresponding pair of a convex part and a concave part which receives therein the convex part, one of the convex part and the concave part being formed at an end portion of each key, the convex part having a pair of outer side faces which are laterally opposite to each other and the concave part having a pair of inner side faces which are laterally opposite to each other, the convex part being fitted into the concave part such that one outer side face and one inner side face are in line contact with each other while another outer side face and another inner side face are in spot contact with each other, thereby the support means allowing the pivotal primary stroke movement of each key in a vertical direction, and allowing an adjustive pivotal displacement of the same key in a lateral direction, while prohibiting a subsidiary torsional displacement of the same key; and coupling means for coupling the convex part and the concave part with each other.

* * * * *